US008995850B2

(12) United States Patent
Miyahara et al.

(10) Patent No.: US 8,995,850 B2
(45) Date of Patent: Mar. 31, 2015

(54) IMAGE FORMING APPARATUS WITH CARTRIDGE-REPLACEMENT INDICATOR

(71) Applicants: Kensuke Miyahara, Nagoya (JP); Ayumi Hiro, Kanie-cho (JP)

(72) Inventors: Kensuke Miyahara, Nagoya (JP); Ayumi Hiro, Kanie-cho (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/026,678

(22) Filed: Sep. 13, 2013

(65) Prior Publication Data

US 2014/0072314 A1 Mar. 13, 2014

(30) Foreign Application Priority Data

Sep. 13, 2012 (JP) ..... 2012-201864

(51) Int. Cl.
*G03G 21/00* (2006.01)
*G03G 13/08* (2006.01)
*G03G 15/00* (2006.01)

(52) U.S. Cl.
CPC ..... *G03G 13/08* (2013.01); *G03G 15/556* (2013.01)
USPC ..... 399/27

(58) Field of Classification Search
USPC ..... 399/27, 111
See application file for complete search history.

(56) References Cited

U.S. PATENT DOCUMENTS 5,887,228 A * 3/1999 Motohashi et al. ..... 399/111

FOREIGN PATENT DOCUMENTS

JP 2011-232497 A 11/2011

* cited by examiner

*Primary Examiner* — Quana M Grainger
(74) *Attorney, Agent, or Firm* — Banner & Witcoff, Ltd.

(57) ABSTRACT

An image forming apparatus includes: a first cartridge configured to contain developer of a first color; a second cartridge configured to contain developer of a second color; a processor; and memory storing computer readable instructions that, when executed by the processor, causing the image forming apparatus to: indicate the necessity to replace the first cartridge by using at least information based on a first use amount and information based on a number of printed sheets; and indicate the necessity to replace the second cartridge by using at least information based on a second use amount without using the information based on the number of printed sheets.

10 Claims, 11 Drawing Sheets

IMAGE FORMING APPARATUS WITH CARTRIDGE-REPLACEMENT INDICATOR

CROSS-REFERENCE TO RELATED APPLICATIONS

This application claims priority from Japanese Patent Application No. 2012-201864 filed on Sep. 13, 2012, the entire subject matter of which is incorporated herein by reference.

TECHNICAL FIELD

Illustrative aspects of the present invention relate to an image forming apparatus having a control device configured to indicate a necessity to replace a developer container.

BACKGROUND

For an image forming apparatus, there has been proposed a control device which indicates a necessity to replace a cartridge in a case where a remaining amount of toner in the cartridge detected by an optical sensor is less than a defined value, or in a case where a number of revolutions of a developing roller detected by a revolution counter exceeds a defined value.

SUMMARY

Illustrative aspects of the present invention appropriately determine a timing for replacement of each cartridge in an image forming apparatus having a plurality of cartridges.

According to one illustrative aspect of the present invention, there is provided an image forming apparatus comprising: a first cartridge configured to contain developer of a first color; a second cartridge configured to contain developer of a second color; a processor; and memory. The memory store computer readable instructions that, when executed by the processor, causing the image forming apparatus to indicate a necessity to replace the first cartridge and the second cartridge. The processor is configured to cause the image forming apparatus to: indicate the necessity to replace the first cartridge by using at least information based on a first use amount, which corresponds to an amount of use of the developer of the first color contained in the first cartridge, and information based on a number of printed sheets; and indicate the necessity to replace the second cartridge by using at least information based on a second use amount, which corresponds to an amount of use of the developer of the second color contained in the second cartridge, without using the information based on the number of printed sheets.

DETAILED DESCRIPTION

<General Overview>

Figure 1:
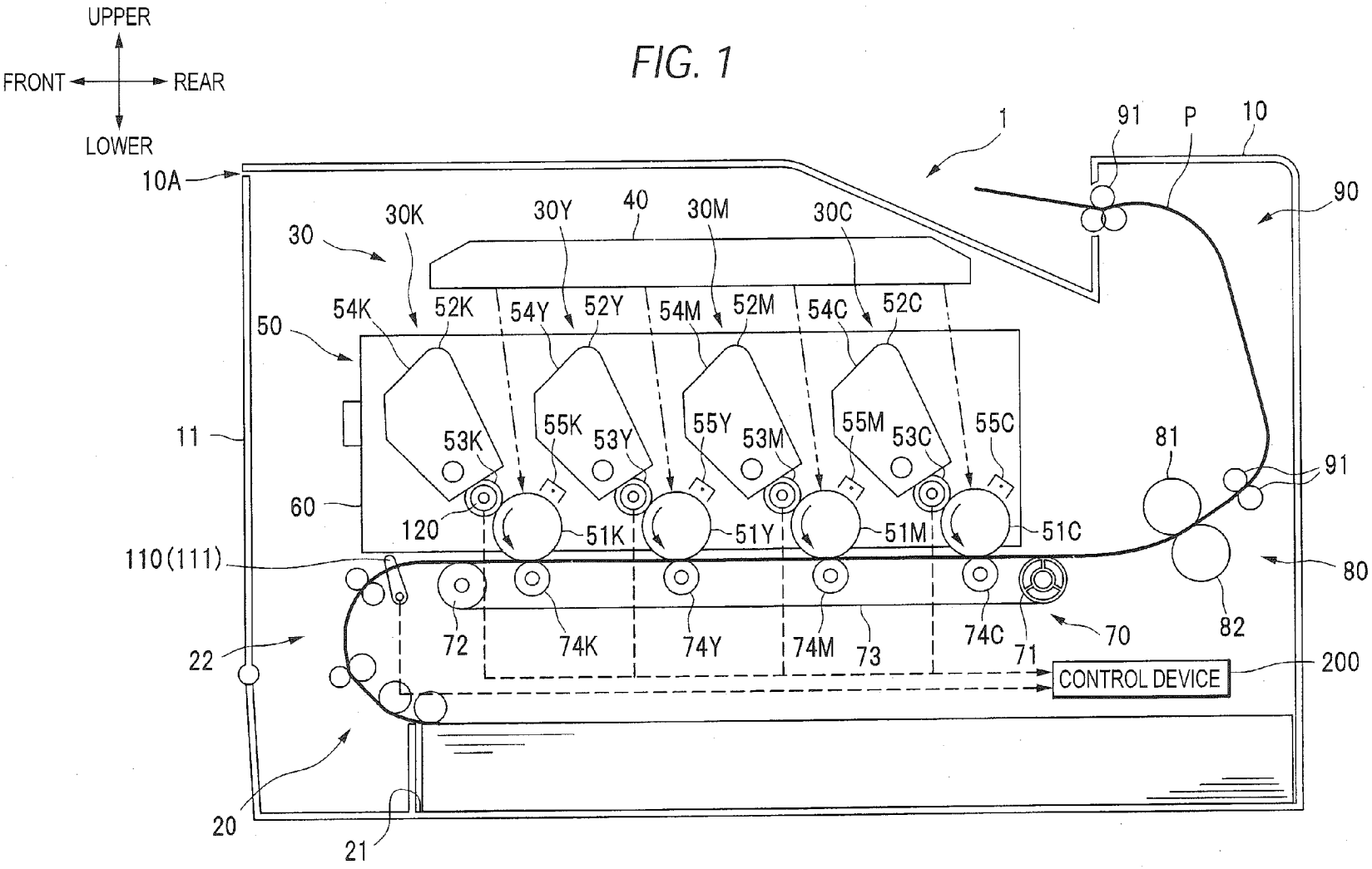
FIG. 1 is an explanatory view schematically illustrating a color printer according to a first exemplary embodiment.

In the above-described related-art method, since an influence of paper dust coming into a cartridge during printing control is not considered, a printing defect may result from the influence of paper dust before the remaining amount of toner or the number of revolutions of a developing roller satisfies the above-described condition. In order to solve this problem, for example, it may be considered to add a condition for the number of printed sheets as a condition for determining replacement of a cartridge. However, in a color printer having a plurality of cartridges, there exist a cartridge which is easy for the paper dust to enter, and a cartridge which is difficult for the paper dust to enter due to layout of the cartridges. Thus, it may be difficult to perform appropriate control even if a condition for the number of printed sheets is simply added.

Therefore, illustrative aspects of the present invention appropriately determine a timing for replacement of each cartridge in an image forming apparatus having a plurality of cartridges.

According to a first illustrative aspect of the present invention, there is provided an image forming apparatus comprising: a first cartridge configured to contain developer of a first color; a second cartridge configured to contain developer of a second color; a processor; and memory. The memory store computer readable instructions that, when executed by the processor, causing the image forming apparatus to indicate a necessity to replace the first cartridge and the second cartridge. The processor is configured to cause the image forming apparatus to: indicate the necessity to replace the first cartridge by using at least information based on a first use amount, which corresponds to an amount of use of the developer of the first color contained in the first cartridge, and information based on a number of printed sheets; and indicate the necessity to replace the second cartridge by using at least information based on a second use amount, which corresponds to an amount of use of the developer of the second color contained in the second cartridge, without using the information based on the number of printed sheets.

According to this configuration, for example, in a case where the first cartridge is configured to be easier for powder generated from sheets to enter, compared to the second cartridge, it is possible to appropriately determine a timing for replacement of each cartridge.

Consequently, information based on the number of printed sheets (information corresponding to an amount of sheet powder) is used to indicate the necessity to replace the first cartridge. Thus, for example, even before the condition for the amount of use is satisfied, when the condition for the number of printed sheets is satisfied, the necessity to replace the first cartridge is indicated. Therefore, before the first cartridge is influenced by sheet powder entering the first cartridge, it is possible to replace the first cartridge, and to improve image quality.

Further, the information based on the number of printed sheets is not used to determine the timing for replacement of the second cartridge. Therefore, it is possible to appropriately determine the timing for replacement of the second cartridge unlikely to be influenced by sheet powder, according to the amount of use of the developer.

According to a second illustrative aspect of the present invention, the processor is configured to cause the image forming apparatus to: in a case where any one condition of a plurality of conditions including at least a first condition that the first use amount exceeds a first threshold value and a second condition that the number of printed sheets exceeds a third threshold value is satisfied, indicate the necessity to replace the first cartridge; and in a case where the second use amount exceeds a second threshold value, indicate the necessity to replace the second cartridge.

According to a third illustrative aspect of the present invention, the plurality of conditions includes a third condition that a driving amount of a rotator for performing conveyance of the developer exceeds a fourth threshold value. According to a fourth illustrative aspect of the present invention, the third condition is that a driving amount of a rotator of the first cartridge for performing conveyance of the developer of the first color exceeds the fourth threshold value.

According to this configuration, the condition for the driving amount of the rotator is also used to determine the timing for replacement of each cartridge. Therefore, even in a case where the driving amount of the rotator increases and the developer is deteriorated, it is possible to urge replacement of the corresponding cartridge.

According to a fifth illustrative aspect of the present invention, the processor is configured to cause the image forming apparatus to: in a case where the first use amount exceeds a first threshold value, indicate the necessity to replace the first cartridge; in a case where the second use amount exceeds a second threshold value, indicate the necessity to replace the second cartridge; and in a case where the number of printed sheets exceeds a third threshold value, change the first threshold value to a sixth threshold value that is smaller than the first threshold value.

According to a sixth illustrative aspect of the present invention, the processor is configured to cause the image forming apparatus to: in a case where the first use amount exceeds a first threshold value, indicate the necessity to replace the first cartridge; in a case where the second use amount exceeds a second threshold value, indicate the necessity to replace the second cartridge; and in a case where the number of printed sheets exceeds a third threshold value, perform correction on the first use amount such that the corresponding amount of use increases than normal.

According to a seventh illustrative aspect of the present invention, the image forming apparatus further comprises an optical sensor configured to measure the first use amount and the second use amount.

According to an eighth illustrative aspect of the present invention, the number of printed sheets is counted by a page counter.

According to a ninth illustrative aspect of the present invention, the image forming apparatus further comprises a sheet sensor configured to detect passage of a sheet, wherein the page counter is configured to count the number of printed sheets on a basis of an output value from the sheet sensor.

According to this configuration, the timing for replacement of the first cartridge is determined on the basis of the number of sheets actually printed. Therefore, it is possible to efficiently suppress the influence of sheet powder.

According to a tenth illustrative aspect of the present invention, the rotator is a developing roller, and the driving amount is the number of revolutions of the developing roller.

According to the present invention, in an image forming apparatus having a plurality of cartridges, it is possible to appropriately determine a timing for replacement of each cartridge.

<Exemplary Embodiments>

Exemplary embodiments of the present invention will now be described with reference to the drawings.

[First Exemplary Embodiment]

Subsequently, a first exemplary embodiment of the present invention will be described. In the following description, first, the overall configuration of a color printer which is an example of an image forming apparatus will be described, and then the characterizing portions of the present invention will be described in detail.

In the following description, directions of a color printer refer to the directions as seen from a user facing to the color printer during its use. To be more specific, referring to FIG. 1, a left-side direction and a right-side direction of the drawing sheet are referred to as a "front side" and a "rear side" of the color printer, respectively. Also, a direction away from a viewer of FIG. 1 is referred to as a "left side", and a direction toward the viewer of FIG. 1 as a "right side". An upward and downward direction in FIG. 1 is referred to as a "vertical direction" or an "upward and downward direction" as it is.

As shown in FIG. 1, a color printer 1 includes a sheet feeding unit 20 configured to feed a sheet P, an image forming unit 30 configured to form an image on the fed sheet P, and a sheet discharging unit 90 configured to discharge the sheet P, on which the image has been formed, inside a main apparatus body 10.

The sheet feeding unit 20 includes a sheet feeding tray 21 and a sheet conveying device 22. The sheet feeding tray 21 is configured to accommodate the sheet P. The sheet conveying device 22 is configured to convey the sheet P from the sheet feeding tray 21 to the image forming unit 30.

The image forming unit 30 includes a scanner unit 40, a process unit 50, a transfer unit 70 and a fixing unit 80.

The scanner unit 40 is provided at an upper portion of the inside of the main apparatus body 10. The scanner unit 40 includes a laser beam emitting unit, a polygonal mirror, lenses, a reflective mirror, etc. (not shown). Further, in the scanner unit 40, laser beams are irradiated onto the surfaces of photosensitive drums 51 which are examples of photosensitive elements (which will be described later), through paths shown by alternate long and two short dashes lines in FIG. 1, during high-speed scanning.

The process unit 50 is configured to be installable in and removable from the main apparatus body 10 through an opening 10A which is formed by opening a front cover disposed on a front surface of the main apparatus body 10. The process unit 50 includes a drawer 60, four photosensitive drums 51 that are rotatably supported by the drawer 60, four developing cartridges 52 that are removably installed as examples of cartridges in the drawer 60 such that the developing cartridges correspond to the photosensitive drums 51, respectively.

Incidentally, in this specification and the drawings, in a case of specifying the photosensitive drums 51, the developing cartridges 52 and the like corresponding to colors of toner (e.g., developer), symbols of K, Y, M and C corresponding to black, yellow, magenta and cyan are added to their reference symbols. Further, in a case of describing the photosensitive drums 51 and so on, regardless of the colors of toner, the above-described symbols of K, Y, M and C are omitted.

The photosensitive drums 51 are arranged along a front-rear direction (e.g., a predetermined direction) in a state where the process unit 50 is installed in the main apparatus body 10. In the drawer 60, other components such as four chargers 55 configured to expose the photosensitive drums 51 are appropriately provided. Further, each of the developing cartridges 52 includes a developing roller 53 configured to feed toner to a corresponding photosensitive drum 51, a toner container 54 configured to accommodate the toner, and other components such as a known layer-thickness regulating blade and a feeding roller.

Figure 2:
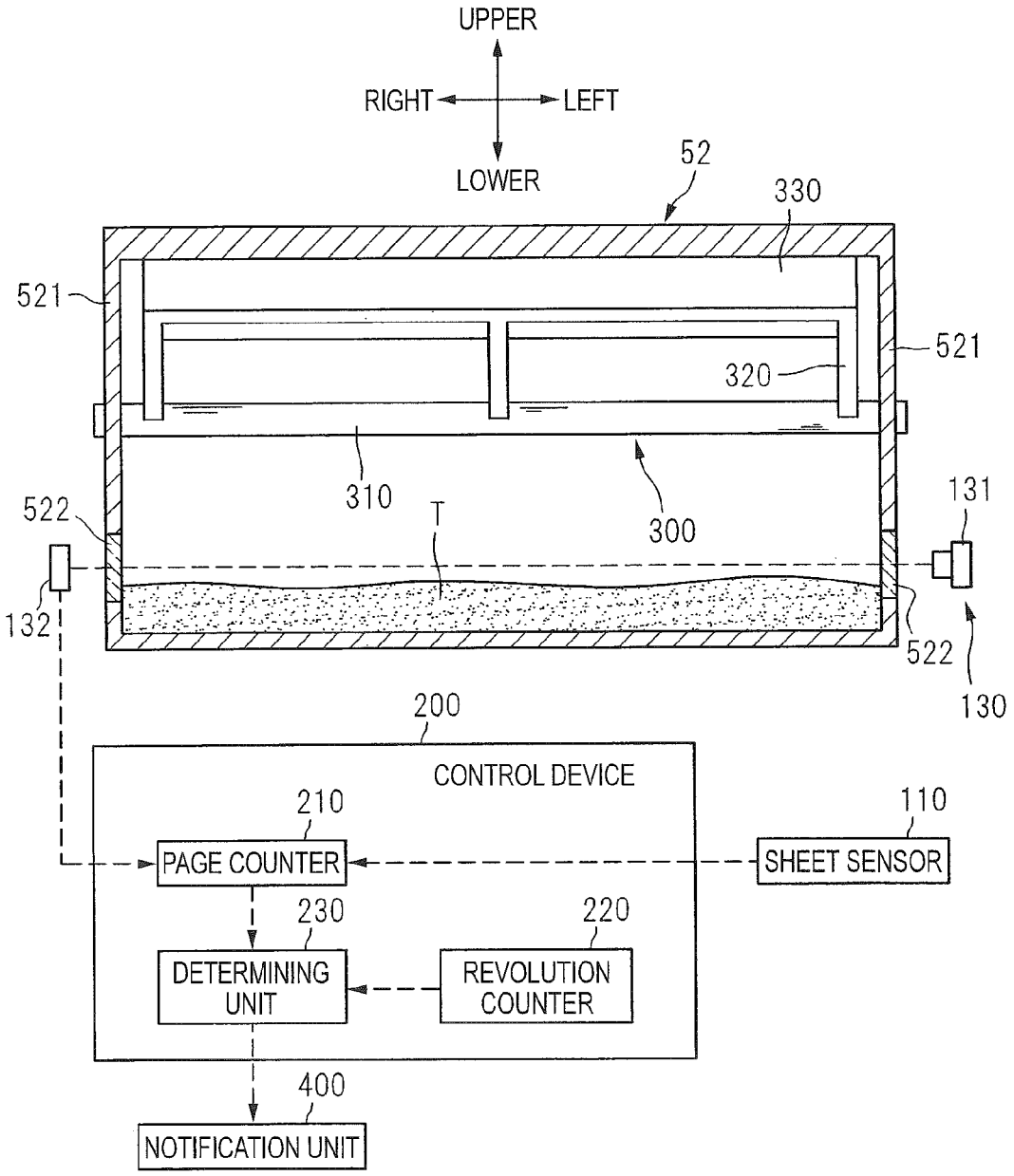
FIG. 2 is an explanatory view illustrating components such as various sensors and a control device.

Inside each developing cartridge 52, as shown in FIG. 2, an agitator 300 configured to stir toner T contained in the corresponding developing cartridge is provided. The agitator 300 includes a rotating spindle 310, a sheet attachment portion 320 and a sheet member 330.

The rotating spindle 310 is a shaft extending along the axial direction of a corresponding developing roller 53 (e.g., a left-right direction), and both ends of the rotating spindle 310 are rotatably supported on left and right side walls 521 of the corresponding developing cartridge 52. The sheet attachment portion 320 is formed to extend radially outward from the rotating spindle 310, and on the fore end of the sheet attachment portion 320, the sheet member 330 is fixed by adhering or the like.

The sheet member 330 is configured to stir the toner T while its fore end is in sliding contact with the wall of the toner container 54, according to the rotation of the agitator 300.

Further, at the left and right side walls 521 of each developing cartridge 52, a pair of transmission windows 522 configured to transmit light of a toner sensor 130 (which will be described later) is provided.

Referring to FIG. 1 again, the transfer unit 70 is provided between the sheet feeding unit 20 and the process unit 50. The transfer unit 70 includes a driving roller 71, a driven roller 72, a conveyance belt 73 and transfer rollers 74 which are examples of transfer members.

The driving roller 71 and the driven roller 72 are disposed in parallel with an interval in the front-rear direction. The conveyance belt 73, which is composed of an endless belt, is stretched between the driving roller 71 and the driven roller 72. The outer surface of the conveyance belt 73 comes into contact with the photosensitive drums 51. Further, inside the conveyance belt 73, four transfer unit 70 are provided to face the photosensitive drums 51 with the conveyance belt 73 interposed therebetween. During transferring, a transfer bias is applied to each transfer roller 74 by constant current control.

The fixing unit 80 is disposed behind the process unit 50 and the transfer unit 70. The fixing unit 80 includes a heating roller 81 and a pressing roller 82. The pressing roller 82 is disposed to face the heating roller 81 and is configured to press the heating roller 81.

In the image forming unit 30 having the above-described configuration, first, the surfaces of the photosensitive drums 51 are uniformly charged by the chargers 55, and then are exposed by the scanner unit 40. As a result, the potentials of exposed portions decrease, whereby electrostatic latent images based on image data are formed on the photosensitive drums 51. Subsequently, the toner contained in the developing cartridges 52 is fed to the electrostatic latent images formed on the photosensitive drums 51 by the developing rollers 53, whereby toner images are carried on the photosensitive drums 51.

Next, a sheet P fed on the conveyance belt 73 passes between the photosensitive drums 51 and the transfer rollers 74, whereby the toner images formed on the photosensitive drums 51 are transferred onto the sheet P. Then, the sheet P passes between the heating roller 81 and the pressing roller 82, whereby the toner image transferred on the sheet P is thermally fixed.

The sheet discharging unit 90 includes a plurality of conveying rollers 91 configured to convey the sheet P. The sheet P with the toner image transferred and thermally fixed thereon is conveyed by the conveying rollers 91, and is discharged to the outside of the main apparatus body 10.

A control device 200 is provided inside the main apparatus body 10. The control device 200 is configured to control the color printer 1 having the above-described configuration.

(Image Forming Unit 30 and Control Device 200)

Four image forming sections 30K, 30Y, 30M and 30C are sequentially arranged in order of black, yellow, magenta and cyan from an upstream side to a downstream side of a conveyance direction of a sheet P. In other words, in the present exemplary embodiment, among a plurality of image forming sections 30, an image forming section 30K for black (a first color) which is disposed on the most upstream side corresponds to a first image forming section, and an image forming section 30Y, 30M and/or 30C for a color other than black (a second color) such as yellow, magenta and cyan corresponds to a second image forming section. Incidentally, in the following description, if necessary, the term "first" is added to the heads of names of members and the like corresponding to black, and the term "second" is added to the heads of names of members and the like corresponding to yellow, magenta and cyan.

The first developing cartridge 52K is disposed on the most upstream side in the conveyance direction of the sheet P, such that the first developing cartridge 52K is easier for paper dust generated from the sheet P to enter, as compared to the second developing cartridges 52Y, 52M and 52C disposed on the downstream side. Specifically, paper dust having not been recovered by a belt cleaning roller (not shown) is brought to the positions of the photosensitive drums 51 by rotation of the conveyance belt 73. Then, paper dust attached to the photosensitive drums 51 is attached to the developing rollers 53 and enters the developing cartridges 52. Since the belt cleaning roller is disposed below the conveyance belt 73, a large amount of the paper dust having not been recovered by the belt cleaning roller enters the developing cartridge 52K disposed on the most upstream side. Then, the timing for replacement of each developing cartridge 52 is determined by the control device 200.

The control device 200 includes, for example, a CPU (which is an abbreviation for central processing unit), a RAM (which is an abbreviation for random access memory), a ROM (which is an abbreviation for read only memory) and an input/output circuit. The control device 200 is configured to perform computing processes on the basis of inputs from various sensors, the contents of a print command, and programs, data and the like stored in the ROM, thereby performing a known warm-up operation, printing control, etc. Here, the warm-up operation means a printing preparation operation, specifically, control to rotate the agitators 300, the developing rollers 53 and the like for a predetermined period before feeding of the sheet P from the sheet feeding tray 21 starts.

Further, in the present exemplary embodiment, especially, the control device 200 is configured to perform control to determine a timing for replacement of each developing cartridge 52 on the basis of inputs from a sheet sensor 110, which serves as an example of a sheet sensor, and the toner sensors 130 (shown in FIGS. 1 and 2), and the numbers of revolutions of the developing rollers 53 counted by a revolution counter 220 (which will be described later). Incidentally, the toner sensors 130 are provided on a one-to-one basis for the developing cartridges 52; however, in FIG. 2, for the sake of convenience, only one toner sensor 130 is representatively shown.

The sheet sensor 110 is configured to detect passage of a sheet P. The sheet sensor 110 is disposed on a conveyance path between the sheet conveying device 22 and the image forming unit 30 (the conveyance belt 73). A detection value detected by the sheet sensor 110 is output to the control device 200.

Incidentally, the sheet sensor 110 has a known structure. To provide a brief explanation, the sheet sensor 110 is composed of a detection arm 111, which is configured to swing by being in contact with the sheet P, and an optical sensor configured to detect swinging of the detection arm.

The toner sensors 130 are optical sensors. Each toner sensors 130 include a light emitting unit 131 and a light receiving unit 132. The light emitting unit 131 and the light receiving unit 132 are disposed to face each other such that a pair of transmission windows 522 provided at the left and right side walls 521 of a corresponding developing cartridge 52 is interposed therebetween in the left-right direction.

As shown by a broken line in FIG. 2, light emitted from the light emitting unit 131 enters the corresponding developing cartridge 52 through one transmission window 522 and is received by the light receiving unit 132 through the other transmission window 522. The light receiving unit 132 is an element whose output voltage value varies according to the intensity of received light. The light receiving unit 132 is configured to receive light and output a light reception signal (a light reception amount) to the control device 200 (specifically, a determining unit 230). More specifically, the toner T is stirred by the agitators 300, and then the light emitting units 131 emit light. Then, the light receiving units 132 detect light reception amounts corresponding to the amounts of use of the toner T.

Here, a first light reception amount, which is detected by a toner sensor 130 for the first developing cartridge 52K, corresponds to a first use amount showing the amount of use of toner stored in the first developing cartridge 52K. Also, a second light reception amount detected by a toner sensor 130 for the second developing cartridge (e.g., 52Y, 52M and 52C) corresponds to a second use amount showing the amount of use of toner stored in the second developing cartridge (52Y, 52M and 52C).

The control device 200 is configured to include a page counter 210, the revolution counters 220 and the determining unit 230.

The page counter 210 is configured to count the number of sheets P printed using the first developing cartridge 52K. Specifically, the page counter 210 is configured to count the number of sheets P printed using the first developing cartridge 52K (that is, the total number of printed sheets) on the basis of an output value from the sheet sensor 110.

More specifically, the page counter 210 starts to count the total number of printed sheets from when a new first developing cartridge 52K is installed in the main apparatus body 10, and counts up the total number of printed sheets whenever printing control is performed, until the life of the corresponding first developing cartridge 52K comes to an end (that is, replacement timing of the corresponding first developing cartridge comes). Further, when the lifetime of the first developing cartridge 52K comes (when performing indication of a necessity to replace, which will be described later), the page counter 210 resets the total number of printed sheets to zero. The resetting of the total number of printed sheets may be performed when a new developing cartridge is installed.

Incidentally, determination on whether a developing cartridge 52 is new may be performed, for example, using a known new-article detecting mechanism which is provided to the corresponding developing cartridge, or using a known contactless memory which is provided to the corresponding developing cartridge.

The total number of printed sheets counted by the page counter 210 is output to the determining unit 230.

Each revolution counter 220 has a function of counting the total number of revolutions of a corresponding developing roller 53, as an example of a driving amount. Specifically, similarly to the page counter 210, each revolution counter 220 counts up the total number of revolutions of a corresponding developing cartridge 52 from when the corresponding developing cartridge 52 is new to when the life of the corresponding developing cartridge 52 comes to an end. Further, each revolution counter 220 resets the total number of revolutions to zero upon indicating a necessity to replace the corresponding developing cartridge 52 is performed. The resetting of the total number of revolutions may be performed when a new developing cartridge is installed.

Here, a first total number of revolutions of the first developing cartridge 52K counted by a revolution counter 220 corresponds to a first driving amount. A second total number of revolutions of the second developing roller (e.g., 53Y, 53M and 53C) counted by the revolution counter 220 corresponds to second driving amounts. Further, each total number of revolutions counted by the revolution counter 220 is output to the determining unit 230.

The determining unit 230 is configured to determine a timing for replacement of each developing cartridge 52 on the basis of the light reception amounts from the toner sensors 130, and the total numbers of revolutions from the revolution counters 220. In addition, the determining unit 230 is configured to further use the total number of printed sheets from the page counter 210, as a determination condition, to determine a timing of replacement of the first developing cartridge 52K. In other words, the determining unit 230 is configured to: use a total number of printed sheets corresponding to an amount of paper dust intruded, as a condition, to determine a timing for replacement of the first developing cartridge 52K disposed at the most upstream position where it is easy for paper dust to enter; and not to use a condition for a total number of printed sheets to determine a timing for replacement of each of the second developing cartridges 52Y, 52M and 52C disposed on the downstream side where it is difficult for paper dust to enter.

Further, in a case where the determining unit 230 determines that it is a timing for replacement of a developing cartridge 52 by use of the above-described condition, a notification unit 400 is configured to indicate a message to a user that it is necessary to replace the corresponding developing cartridge 52. As the notification unit 400, for example, a liquid crystal display configured to indicate the message by a text, a picture, and so on, a speaker configured to indicate the message by sound, a lamp configured to indicate the message by flicker of light or the like can be used. Further, a notification unit obtained by combining two or more of a liquid crystal display, a speaker, a lamp and so on can be used.

In other words, the control device 200 is configured to use information based on an amount of use of toner and information based on the number of printed sheets to indicate the necessity to replace the first developing cartridge 52K. Further, the control device 200 is configured to use information based on an amount of use of toner to indicate the necessity to replace each second developing cartridges 52Y, 52M or 52C, without using the information based on the number of printed sheets.

Figure 3:
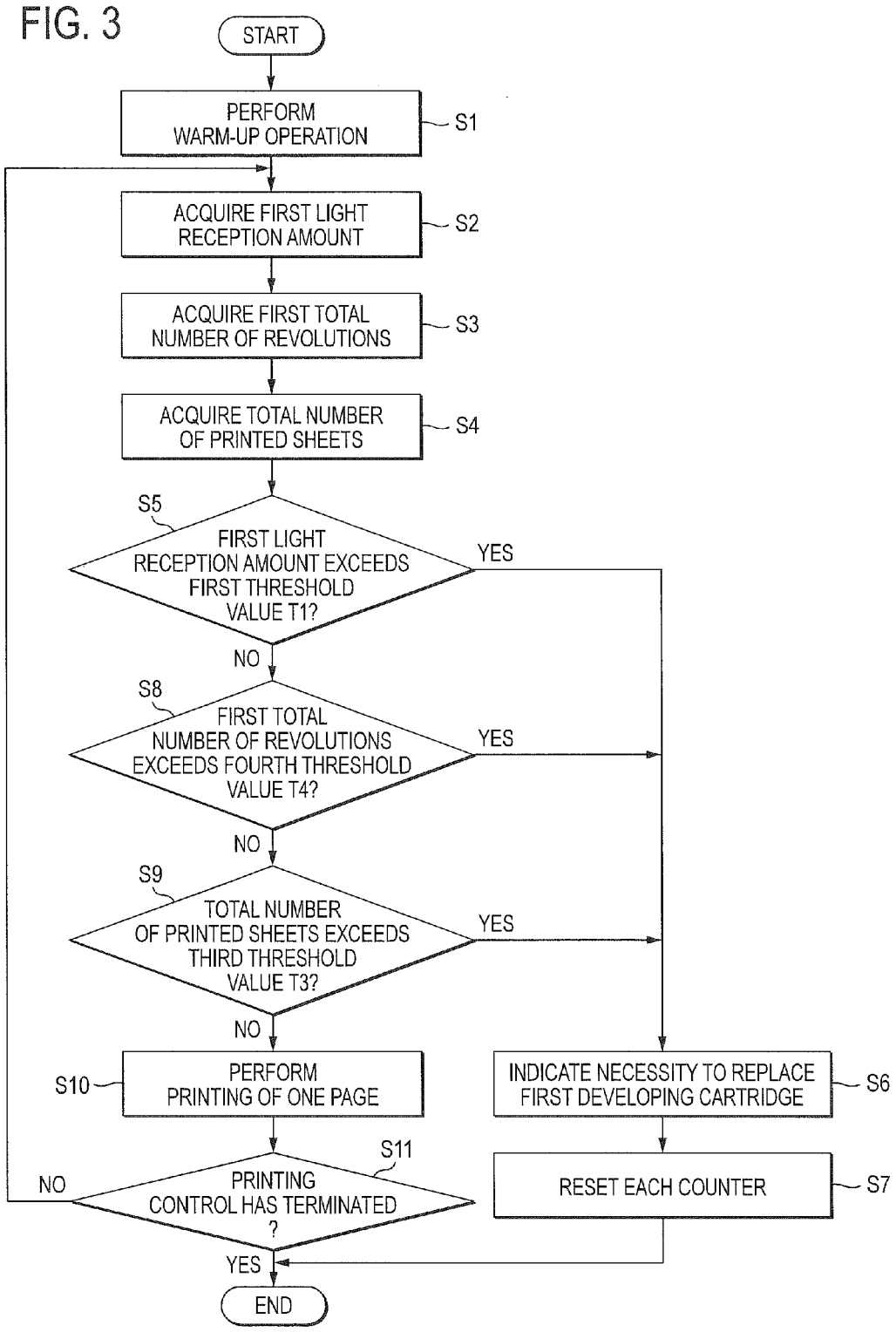
FIG. 3 is a flow chart illustrating a method of determining a timing for replacement of a first developing cartridge.
Figure 4:
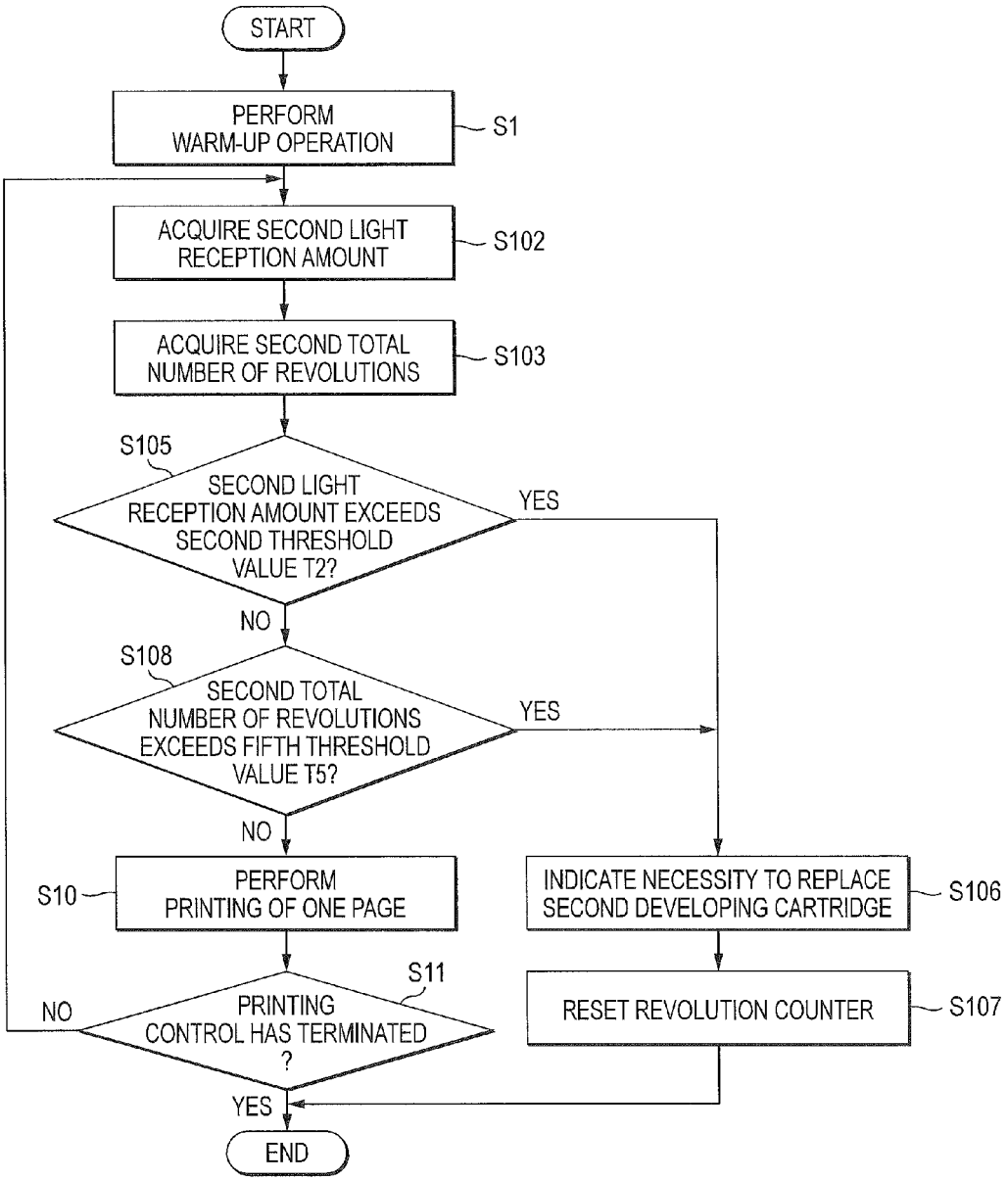
FIG. 4 is a flow chart illustrating a method of determining a timing for replacement of a second developing cartridge.

Specifically, the control device 200 uses a flow chart of FIG. 3 to determine the timing for replacement of the first developing cartridge 52K, and uses a flow chart of FIG. 4 to determine the timing for replacement of each second developing cartridge 52 (for example, 52Y). Incidentally, control based on the flow chart shown in FIG. 4 is performed separately with respect to each of the three second developing cartridges 52Y, 52M and 52C; however, in the following description, determining of the timing for replacement of the second developing cartridge 52Y will be representatively described.

(Control on Determining Timing for Replacement of First Developing Cartridge 52K)

As shown in FIG. 3, upon a print command is received ("START"), first, in STEP S1, the control device 200 performs the above-described known warm-up operation control.

After STEP S1, in STEP S2, the control device 200 acquires a first light reception amount corresponding to an amount of use of toner stored in the first developing cartridge 52K, from a corresponding toner sensor 130. After STEP S2, in STEP S3, the control device 200 acquires a first total number of revolutions of the first developing roller 53K from a corresponding revolution counter 220. Then, in STEP S4, the control device 200 acquires the total number of sheets P printed using the first developing cartridge 52K from the page counter 210.

After STEP S4, in STEP S5, the control device 200 determines whether the first light reception amount exceeds a first threshold value T1 (which means, whether the first light reception amount is larger than the first threshold value T1). In a case where it is determined that the first light reception amount exceeds the first threshold value T1 ("Yes"), in STEP S6, the control device 200 indicates the necessity to replace the first developing cartridge 52K. The first threshold value T1 and a second threshold value T2 (see FIG. 4), which will be described later, are determined by experiments, simulations and so on, and may be the same as or different from each other.

After STEP S6, the control device 200 resets the individual counters 210 and 220 (the total number of revolutions and the total number of printed sheets corresponding to the first developing cartridge 52K) in STEP S7 and then terminates the present control ("END").

In a case where it is determined in STEP S5 that the first light reception amount does not exceed the first threshold value T1 (which means, the first light reception amount is equal to or less than the first threshold value T1) ("No"), in STEP S8, the control device 200 determines whether the first total number of revolutions exceeds a fourth threshold value T4. The fourth threshold value T4 and a fifth threshold value T5 (see FIG. 4), which will be described later, are determined by experiments, simulations and so on, and may be the same as or different from each other.

If it is determined in STEP S8 that the first total number of revolutions exceeds the fourth threshold value T4 ("Yes"), the control device 200 proceeds to the process of STEP S6; otherwise, the control device 200 proceeds to the process of STEP S9. In STEP S9, the control device 200 determines whether the total number of printed sheets exceeds a third threshold value T3. The third threshold value T3 may be determined by experiments, simulations and so on.

If it is determined in STEP S9 that the total number of printed sheets exceeds the third threshold value T3 ("Yes"), the control device 200 proceeds to the process of STEP S6; otherwise ("No"), the control device 200 proceeds to the process of STEP S10. In STEP S10, the control device 200 performs printing control corresponding to one page. Consequently, the control device 200 is configured to indicate the necessity to replace the first cartridge in a case where any one condition of the first condition of STEP S5, the second condition of STEP S9 and the third condition of STEP S8 is satisfied.

After STEP S10, in STEP S11, the control device 200 determines whether the printing control has terminated, that is, whether printing of all pages designated by the print command has terminated. If it is determined in STEP S11 that the printing control has not terminated ("No"), the control device 200 returns to the process of STEP S2; otherwise ("Yes"), the control device 200 terminates the present control ("END").

(Control on Determining Timing for Replacement of Second Developing Cartridge 52Y)

In a control of determine the timing for replacement of the second developing cartridge 52Y, the condition for the total number of printed sheets is not considered. Therefore, the flow chart shown in FIG. 4 is basically a flow chart obtained by deleting the processes of STEPS S4 and S9 of FIG. 3. In the following description, only differences from the flow chart of FIG. 3 will be described, and identical steps to those of FIG. 3 are denoted by the same reference symbols and detailed descriptions thereof will be omitted.

STEPS S102 and S103 are substantially identical to STEPS S2 and S3 of FIG. 3 except that data which are acquired are a second light reception amount and a second total number of revolutions corresponding to the second developing cartridge 52Y. In STEP S105, the control device 200 performs a process substantially identical to that of STEP S5 of FIG. 3. Specifically, the control device 200 determines whether the second light reception amount exceeds the second threshold value T2.

STEP S106 is substantially identical to STEP S6 of FIG. 3, except that a target which is notified is the second developing cartridge 52Y. In STEP S107, the control device 200 resets a corresponding revolution counter 220 (the total number of revolutions corresponding to the second developing cartridge 52Y).

In STEP S108, the control device 200 performs a process substantially identical to that of STEP S8 of FIG. 3. Specifically, the control device 200 determines whether the second total number of revolutions exceeds the fifth threshold value T5.

According to the above-described configuration, in the present exemplary embodiment, it is possible to obtain the following effects.

Figure 5:
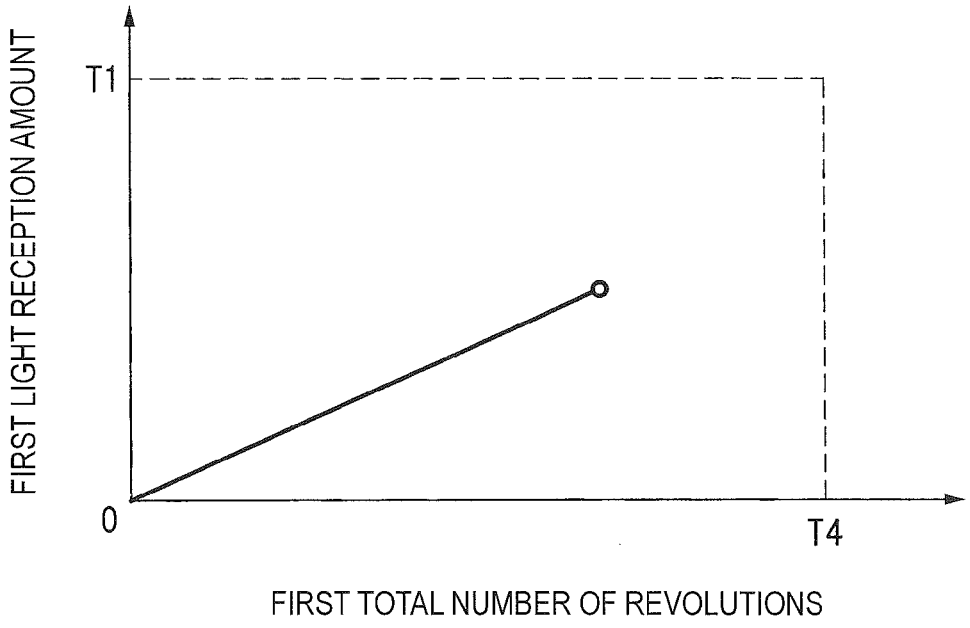
FIG. 5 is an explanatory view illustrating an example of a change in a first light reception amount and a first total number of revolutions.

Not only the first light reception amount and the first total number of revolutions but also the condition for the total number of printed sheets are used to determine the timing for replacement of the first developing cartridge 52K. Therefore, for example, as shown in FIG. 5, before the first light reception amount reaches the first threshold value T1, and even before the first total number of revolutions reaches the fourth threshold value T4, when the total number of printed sheets exceeds the third threshold value T3, the necessity to replace the first developing cartridge 52K is indicated. For this reason, it is possible to replace the first developing cartridge 52K before the first developing cartridge is influenced by paper dust entering the first developing cartridge 52K, and to improve image quality.

Further, the condition for the total number of printed sheets is not used to determine the timing for replacement of each second developing cartridges 52Y, 52M or 52C. Therefore, it is possible to appropriately determine the timings for replacement of each second developing cartridges 52Y, 52M or 52C, which is hard to be influenced by paper dust, according to an amount of use of toner, a deterioration of toner, etc.

Not only the light reception amount but also the total number of revolutions of each developing roller 53 are used to determine a timing for replacement of a corresponding developing cartridge 52. Therefore, even in a case where toner has been deteriorated due to an increase in the total number of revolutions, it is possible to urge replacement of the corresponding developing cartridge 52.

The page counter 210 counts the total number of printed sheets on the basis of the output value from the sheet sensor 110. therefore, it is possible to determine the timing for replacement of the first developing cartridge 52K on the basis of the number of sheets P actually printed, and to efficiently suppress the influence of sheet powder.

[Second Exemplary Embodiment]

Subsequently, a second exemplary embodiment of the present invention will be described in detail with reference to appropriate drawings. The present exemplary embodiment is obtained by changing a portion of the above-described control of the control device according to the first exemplary embodiment. Therefore, steps substantially identical to those of the first exemplary embodiment are denoted by the same reference symbols and detailed descriptions thereof will be omitted.

In the first exemplary embodiment, in a case where the total number of printed sheets exceeds the third threshold value T3 ("Yes" in STEP S9), immediately, the control device proceeds to STEP S6 to indicate the necessity to replace the first developing cartridge 52K. However, in the second exemplary embodiment, when the total number of printed sheets exceeds the third threshold value T3, the control device changes a threshold value for a light reception amount which is compared with the first light reception amount, from the above-described first threshold value T1 to a sixth threshold value T6 that is smaller than the first threshold value T1. As a result, in the case where the total number of printed sheets exceeds the third threshold value T3, the control device proceeds to STEP S6 to indicate the necessity to replace the first developing cartridge 52K. The sixth threshold value T6 needs only to be a value (for example, zero) surely resulting in "Yes" in determination of STEP S50, which will be described later, and may be determined by experiments, simulations and so on.

Figure 6:
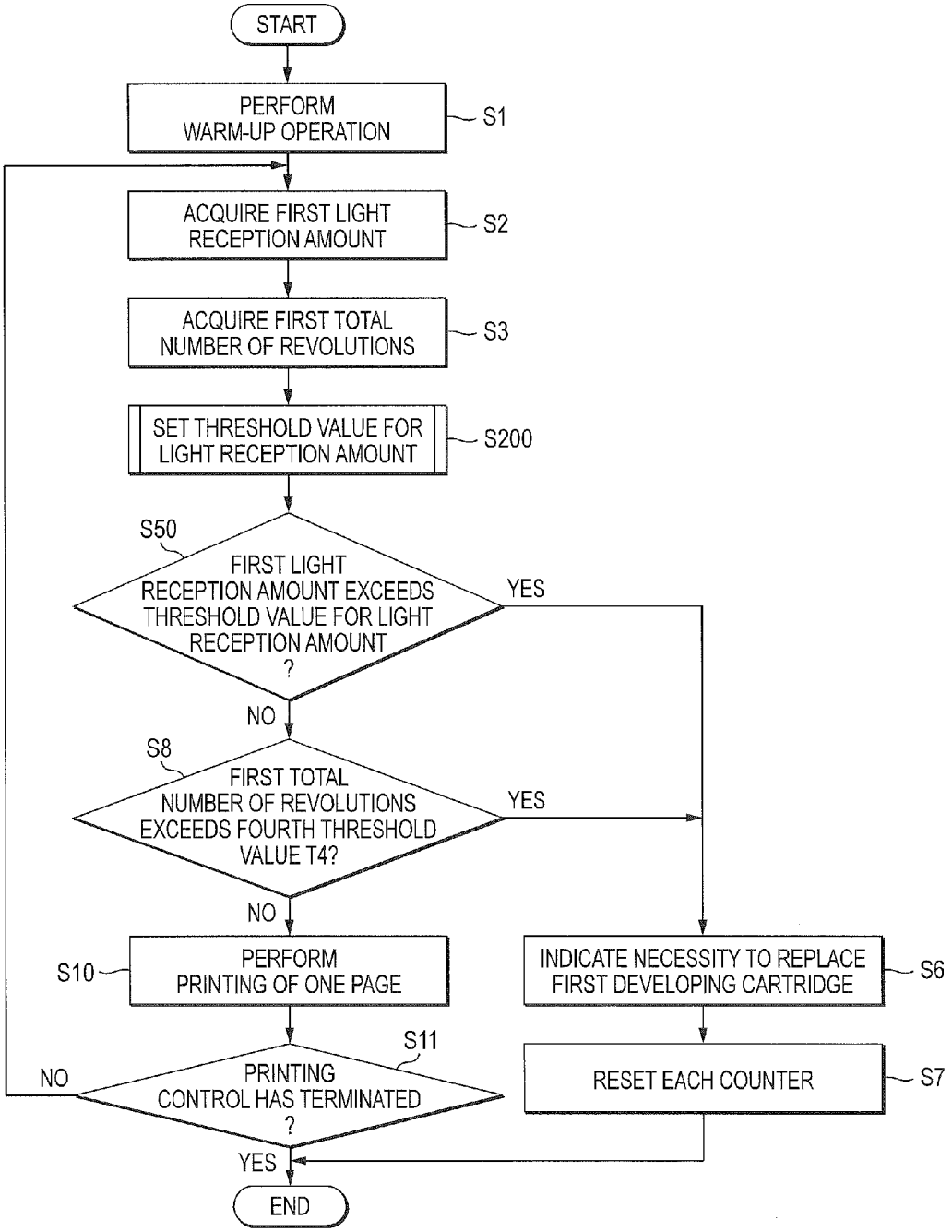
FIG. 6 is a flow chart illustrating a method of determining a timing for replacement according to a second exemplary embodiment.
Figure 7:
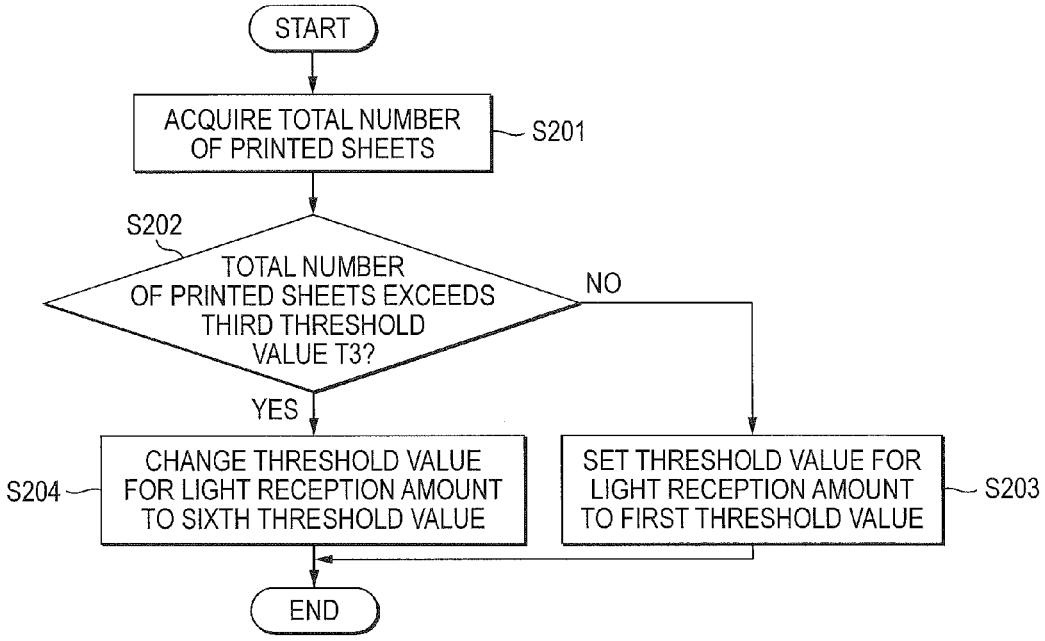
FIG. 7 is a flow chart illustrating a process of setting a threshold value for a light reception amount.

Specifically, the control device is configured to perform control according to flow charts shown in FIGS. 6 and 7. Here, the flow chart shown in FIG. 6 is obtained by eliminating STEPS S4 and S9 from the flow chart shown in FIG. 3, adding a new process of STEP S200 between STEPS S3 and S5, and replacing STEP S5 of FIG. 3 with a process of STEP S50.

In STEP S200, the control device sets a threshold value for a light reception amount. Specifically, as shown in FIG. 7, in STEP S200, first, in STEP S201, the control device acquires the total number of printed sheets from the page counter 210.

After STEP S201, in STEP S202, the control device determines whether the total number of printed sheets exceeds the third threshold value T3. If it is determined in STEP S202 that the total number of printed sheets does not exceed the third threshold value T3 ("No"), the control device sets the threshold value for the light reception amount to the first threshold value T1 in STEP S203, and then proceeds to STEP S50 of FIG. 6.

Meanwhile, if it is determined in STEP S202 that the total number of printed sheets exceeds the third threshold value T3 ("Yes"), the control device changes the threshold value for the light reception amount from the first threshold value T1 to the sixth threshold value T6 that is smaller than the first threshold value T1 in STEP S204, and then proceeds to STEP S50 of FIG. 6. In STEP S50, the control device determines whether the first light reception amount exceeds the threshold value for the light reception amount set in STEP S200.

Figure 8:
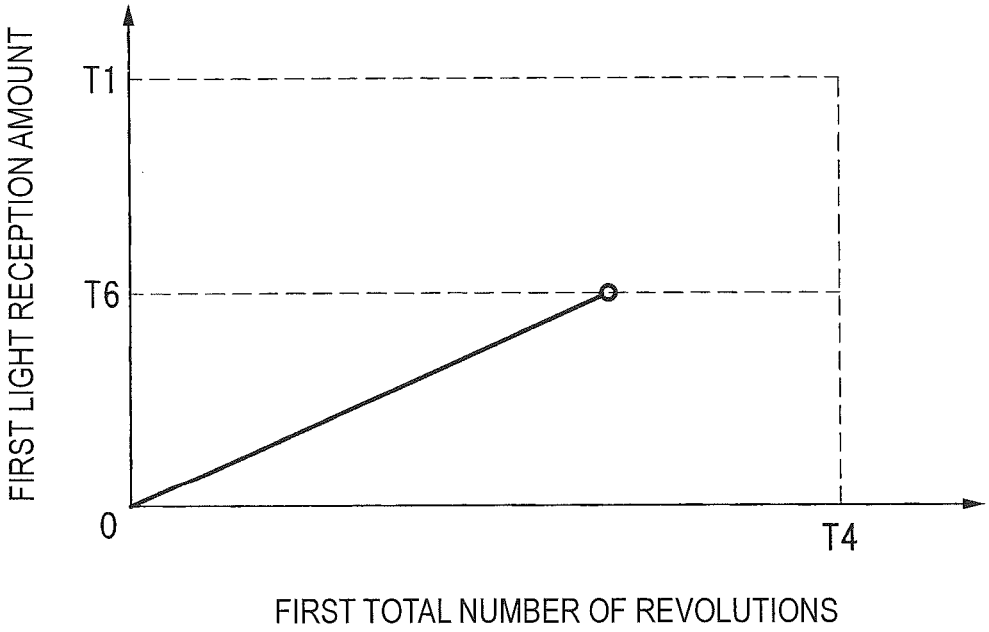
FIG. 8 is an explanatory view illustrating an example of a change in a first light reception amount and a first total number of revolutions according to the second exemplary embodiment.

By configuring the control device as described above, as shown in FIG. 8, before the first light reception amount reaches the first threshold value T1, and even before the first total number of revolutions reaches the fourth threshold value T4, when the total number of printed sheets exceeds the third threshold value T3, the threshold value for the light reception amount is changed to the sixth threshold value T6 smaller than the first threshold value T1. Therefore, it is possible to advance the timing for replacement of the first developing cartridge from a normal timing (a timing when the first light reception amount reaches the first threshold value T1). Therefore, even in this case, it is possible to replace the first developing cartridge before the first developing cartridge is influenced by paper dust, and to improve image quality.

[Third Exemplary Embodiment]

Subsequently, a third exemplary embodiment of the present invention will be described in detail with reference to appropriate drawings. The present exemplary embodiment is obtained by changing a portion of the above-described control of the control device according to the first exemplary embodiment. Therefore, steps substantially identical to those of the first exemplary embodiment are denoted by the same reference symbols and detailed descriptions thereof will be omitted.

In the third exemplary embodiment, the control device performs correction to increase the first light reception amount when the total number of printed sheets exceeds the third threshold value T3. Consequently, in a case where the total number of printed sheets exceeds the third threshold value T3, the control device proceeds to STEP S6 to indicate the necessity to replace the first developing cartridge 52K.

Figure 9:
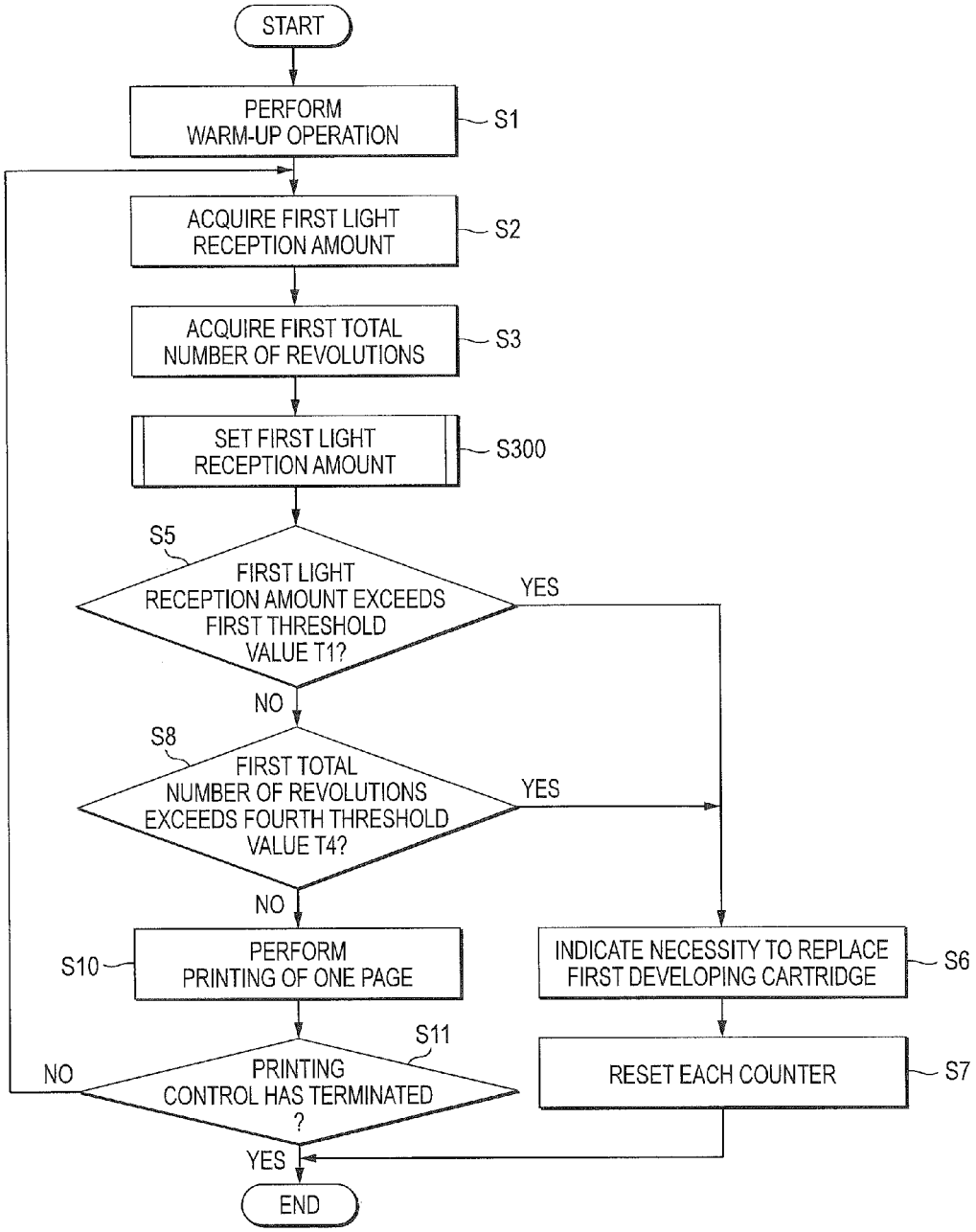
FIG. 9 is a flow chart illustrating a method of determining a timing for replacement according to a third exemplary embodiment.
Figure 10:
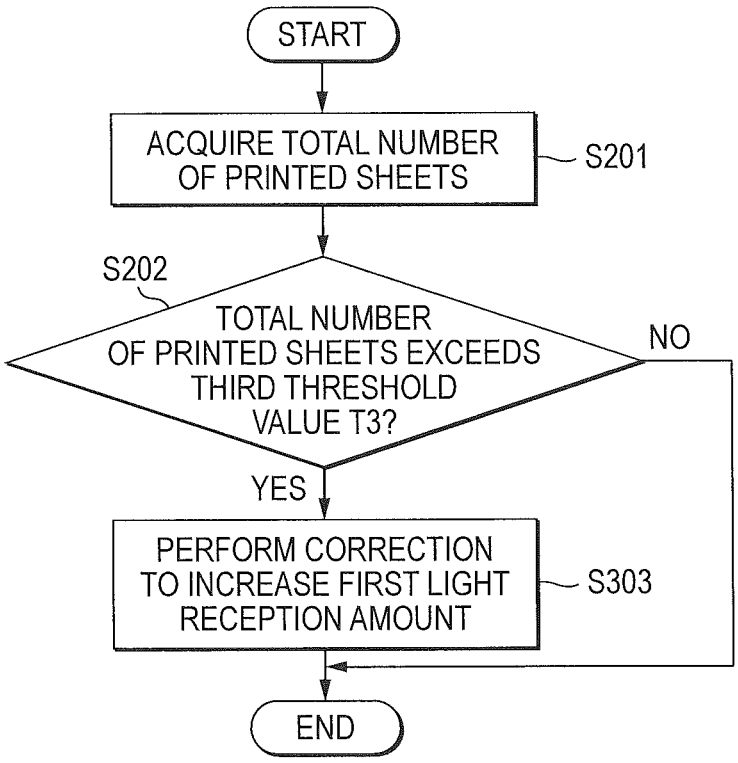
FIG. 10 is a flow chart illustrating another process of setting a threshold value for a light reception amount.

Specifically, the control device is configured to perform control according to flow charts shown in FIGS. 9 and 10. The flow chart shown in FIG. 9 is obtained by eliminating STEPS S4 and S9 from the flow chart shown in FIG. 3 and adding a new process of STEP S300 between STEPS S3 and S5.

In STEP S300, the control device sets the first light reception amount. Specifically, as shown in FIG. 10, in STEP S300, first, the control device performs the same processes as those of STEPS S201 and S202 of the second exemplary embodiment.

If it is determined in STEP S202 that the total number of printed sheets does not exceed the third threshold value T3 ("No"), the control device proceeds to STEP S5 of FIG. 9, without correcting the first light reception amount. Meanwhile, if it is determined in STEP S202 that the total number of printed sheets exceeds the third threshold value T3 ("Yes"), in STEP S303, the control device performs correction to increase the first light reception amount.

The correcting method may be any method, for example, a method of multiplying the first light reception amount by a predetermined coefficient, or a method of adding a predetermined correction value to the first light reception amount. Also, the value of the corrected light reception amount needs only to be a value (for example, a value larger than the first threshold value T1) surely resulting in "Yes" in the determination of STEP S5, and the above-described coefficient or correction value may be determined by experiments, simulations and so on, such that the value of the corrected light reception amount becomes that value.

Figure 11:
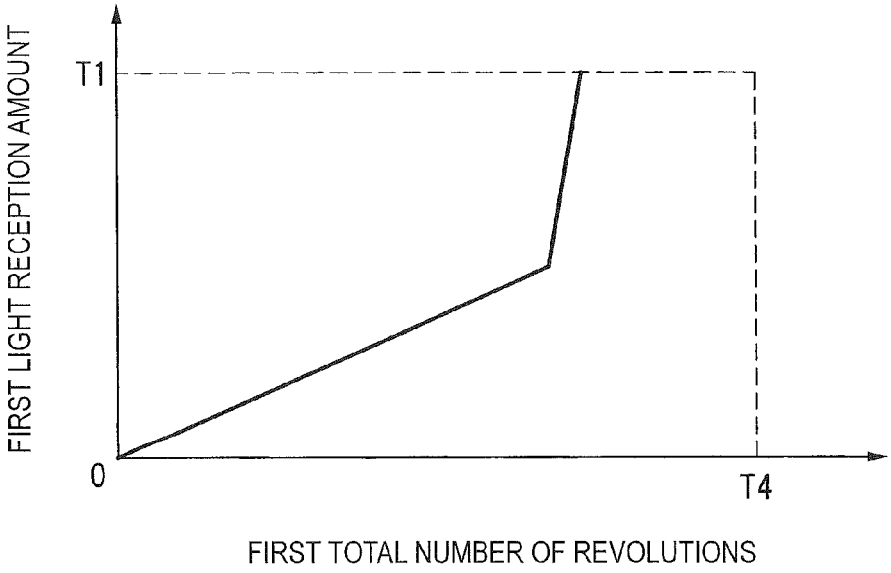
FIG. 11 is an explanatory view illustrating an example of a change in a first light reception amount and a first total number of revolutions according to the third exemplary embodiment.

By configuring the control device as described above, as shown in FIG. 11, before the first light reception amount (uncorrected) reaches the first threshold value T1, and even before the first total number of revolutions reaches the fourth threshold value T4, when the total number of printed sheets exceeds the third threshold value T3, the first light reception amount is corrected to increase such that the first light reception amount instantaneously reaches the first threshold value T1. Therefore, it is possible to advance the timing for replacement of the first developing cartridge from the normal timing (a timing when the uncorrected first light reception amount reaches the first threshold value T1). Therefore, even in this case, it is possible to replace the first developing cartridge before the first developing cartridge is influenced by paper dust and to improve image quality.

Incidentally, in the second and third exemplary embodiments, the light reception amount or the threshold value to be compared with the corresponding light reception amount is changed to advance the timing for replacement of the first developing cartridge from the normal timing. However, the present invention is not limited thereto. For example, the total number of revolutions of the first developing roller or the threshold value to be compared with the corresponding total number of revolutions is changed to advance the replacement timing.

Specifically, for example, in a case where the total number of printed sheets does not exceed the third threshold value T3, the threshold value for the number of revolutions may be set to the fourth threshold value T3, and in a case where the total number of printed sheets exceeds the third threshold value T3, the threshold value for the number of revolutions may be changed from the fourth threshold value T4 to a threshold value smaller than the fourth threshold value T3. Further, for example, in a case where the total number of printed sheets does not exceed the third threshold value T3, the total number of revolutions may not be corrected, and in a case where the total number of printed sheets exceeds the third threshold value T3, correction may be performed on the total number of revolutions such that the total number of revolutions increases.

In the above-described exemplary embodiments, as photosensitive elements, the photosensitive drums 51 have been exemplified. However, the present invention is not limited thereto. For example, belt-type photosensitive elements may be used.

In the above-described exemplary embodiments, each developing roller 53 has been provided integrally with a corresponding developing cartridge 52 serving as a cartridge. However, the present invention is not limited thereto. Each developing roller may be provided to a developing unit which is a component separate from toner cartridges serving as cartridges. Also, a cartridge may be a process cartridge having a photosensitive drum 51 and a developing cartridge 52 integrated with each other.

In the above-described exemplary embodiments, the sheet P such as cardboard, postcard and thin paper have been exemplified as the sheet. However, the present invention is not limited thereto. For example, an OHP sheet may be used.

In the above-described exemplary embodiments, the transfer rollers 74 have been exemplified as the transfer member. However, the present invention is not limited thereto. The transfer member may be any other member such as a conductive brush or a conductive leaf spring configured to transfer bias can be applied.

In the above-described exemplary embodiments, as an amount of use of toner, a light reception amount detected by an optical sensor (a toner sensor 130) has been exemplified. However, the present invention is not limited thereto. For example, a value obtained by integrating the numbers of dots of images printed on sheets may be used as an amount of use.

In the above-described exemplary embodiments, the page counter 210 configured to the total number of printed sheets on the basis of an output value of the sheet sensor 110 has been exemplified. However, the present invention is not limited thereto. The page counter may be configured to integrate data on the numbers of printed sheets included in print commands, thereby computing the total number of printed sheets.

In the above-described exemplary embodiments, the first developing cartridge 52K has been disposed on the most upstream side such that it is easy for paper dust to enter the first developing cartridge. However, the present invention is not limited thereto. For example, a first developer container may be configured to be easy for paper dust to enter due to the features such as color of toner contained therein. That is, since the present invention needs only to be applicable to the first developing cartridge easiest for paper dust to enter, for example, in a case where a first developer container which is easiest for paper dust to enter is specified from among a plurality of developer containers by experiments, simulations and so on, only with respect to a timing for replacement of the specified first developer container, a condition for the total number of printed sheets may be used.

In the above-described exemplary embodiments, as a driving amount of a rotator, the total number of revolutions of each developing roller 53 has been exemplified. However, the present invention is not limited thereto. For example, the total number of revolutions of a member (such as an agitator) connected to a driving gear of a developing roller through a gear, the total number of revolutions of a photosensitive drum, a driving time of a developing roller, and so on may be used.

In the above-described exemplary embodiments, the present invention has been applied to the color printer 1. However, the present invention is not limited thereto. The present invention may be applied to other image forming apparatuses such as a copy machine and a multi-function apparatus.

What is claimed is:

1. An image forming apparatus comprising:

a first cartridge configured to contain developer of a first color;

a second cartridge configured to contain developer of a second color;

a processor; and memory storing computer readable instructions that, when executed by the processor, cause the image forming apparatus to indicate a necessity to replace the first cartridge and a necessity to replace the second cartridge, wherein the processor is configured to cause the image forming apparatus to:

determine a number of printed sheets;

determine a first use amount, which corresponds to an amount of use of the developer of the first color contained in the first cartridge;

determine a second use amount, which corresponds to an amount of use of the developer of the second color contained in the second cartridge;

indicate the necessity to replace the first cartridge by using at least information based on the first use amount and information based on the number of printed sheets; and indicate the necessity to replace the second cartridge by using at least information based on the second use amount, without using the information based on the number of printed sheets.

2. The image forming apparatus according to claim 1, wherein the processor is configured to cause the image forming apparatus to:

in a case where any one condition of a plurality of conditions including at least a first condition that the first use amount exceeds a first threshold value and a second condition that the number of printed sheets exceeds a third threshold value is satisfied, indicate the necessity to replace the first cartridge; and in a case where the second use amount exceeds a second threshold value, indicate the necessity to replace the second cartridge.

3. The image forming apparatus according to claim 2, wherein the plurality of conditions includes a third condition that a driving amount of a rotator for performing conveyance of the developer exceeds a fourth threshold value.

4. The image forming apparatus according to claim 3, wherein the third condition is that a driving amount of a rotator of the first cartridge for performing conveyance of the developer of the first color exceeds the fourth threshold value.

5. The image forming apparatus according to claim 1, wherein the processor is configured to cause the image forming apparatus to:

in a case where the first use amount exceeds a first threshold value, indicate the necessity to replace the first cartridge;

in a case where the second use amount exceeds a second threshold value, indicate the necessity to replace the second cartridge; and in a case where the number of printed sheets exceeds a third threshold value, change the first threshold value to a sixth threshold value that is smaller than the first threshold value.

6. The image forming apparatus according to claim 1, wherein the processor is configured to cause the image forming apparatus to:

in a case where the first use amount exceeds a first threshold value, indicate the necessity to replace the first cartridge;

in a case where the second use amount exceeds a second threshold value, indicate the necessity to replace the second cartridge; and in a case where the number of printed sheets exceeds a third threshold value, perform correction on the first use amount such that the corresponding amount of use increases a normal.

7. The image forming apparatus according to claim 1, further comprising an optical sensor configured to measure the first use amount and the second use amount.

8. The image forming apparatus according to claim 1, wherein the number of printed sheets is counted by a page counter.

9. The image forming apparatus according to claim 8, further comprising a sheet sensor configured to detect passage of a sheet, wherein the page counter is configured to count the number of printed sheets on a basis of an output value from the sheet sensor.

10. The image forming apparatus according to claim 3, wherein the rotator is a developing roller, and wherein the driving amount is anumber of revolutions of the developing roller.

* * * * *